US006425494B1

(12) United States Patent
Woods, II

(10) Patent No.: US 6,425,494 B1
(45) Date of Patent: Jul. 30, 2002

(54) INSULATOR WRAP FOR BEVERAGE CONTAINER

(75) Inventor: Max L. Woods, II, North Bloomfield, OH (US)

(73) Assignee: Global Products, Inc., Brentwood, TN (US)

( * ) Notice: Subject to any disclaimer, the term of this patent is extended or adjusted under 35 U.S.C. 154(b) by 0 days.

(21) Appl. No.: 09/753,418

(22) Filed: Jan. 3, 2001

(51) Int. Cl.[7] ..... B65D 23/08
(52) U.S. Cl. ..... 220/739; 220/903; 215/12.1
(58) Field of Search ..... 220/739, 903, 220/737, 743; 229/452; 215/12.1

(56) References Cited

U.S. PATENT DOCUMENTS

| | | | |
|---|---|---|---|
| 3,410,023 | A | 11/1968 | Anello |
| 4,087,989 | A | 5/1978 | Taran |
| 4,648,525 | A | 3/1987 | Henderson |
| 4,724,548 | A | 2/1988 | London |
| 5,109,588 | A | 5/1992 | Hewlett et al. |
| 5,163,608 | A | 11/1992 | Block |
| 5,176,452 | A | 1/1993 | Stern |
| 5,256,131 | A | 10/1993 | Owens et al. |
| 5,318,821 | A | 6/1994 | Bradley, Jr. |
| 5,325,991 | A | 7/1994 | Williams |
| 5,373,942 | A | 12/1994 | Weder |
| 5,579,949 | A | 12/1996 | Dykes et al. |
| 5,609,265 | A | 3/1997 | Haberkorn et al. |
| 5,845,804 | A | 12/1998 | Prescott |

*Primary Examiner*—Joseph M. Moy
(74) *Attorney, Agent, or Firm*—King & Schickli, PLLC

(57) ABSTRACT

An insulator wrap for a beverage container is formed by a substantially rectangular body of insulation material. A self-coiling spring strip is embedded in the body along approximately the longitudinal center line. Because the spring strip is curved in lateral cross section, the wrap is held straight when uncoiled to allow easy storage and handling when not in use. Simple manual pressure frees the spring strip to self-coil inwardly to cause the wrap to extend around the container for use. Extended portions of the rectangular body isolate the spring strip from the edges of the body. In one embodiment, the extended body portions are one and one half times as wide as the spring strip. A foam insert is positioned within the elongated concave trough of the spring strip to provide a substantially smooth display surface for graphics and indicia in either the uncoiled or self-coiled states. Stiffening stays are embedded laterally across the ends of the body to provide additional snugging force and to hold the top and bottom comers of the body securely against the container during use.

10 Claims, 3 Drawing Sheets

10
12
13
14
20
21
22
35
40
L
C
2
3
7
$R_1$
$R_2$

INSULATOR WRAP FOR BEVERAGE CONTAINER

FIELD OF THE INVENTION

The present invention relates to insulators for beverage containers, and more particularly, to an insulator wrap of a simplified construction and incorporating an improved self-coiling feature for wrapping the container.

BACKGROUND OF THE INVENTION

Insulators for beverage containers have become increasingly popular in recent years. The most popular, and thus the standard in the field, is a simple foam cylinder that receives the container through the open top. There have been many innovations in recent years in an attempt to provide even more consumer attractive models of this basic design. However, one very limiting drawback to this most popular model of the container insulators is that it is bulky and difficult to store when not in use. Because the cylinder typically remains in an open configuration, when it is attempted to be stored, such as in the glove compartment of an automobile, it becomes mashed and generally unsightly. Any graphics that have been printed around the outer periphery of the cylinder become distorted and subject to cracking, adding the unsightliness of the insulator.

One example of the efforts to improve the cylinder type container insulator of the prior art is illustrated in the U.S. Pat. No. 4,648,525, issued Mar. 10, 1987. As can be seen in this patent, the solution being provided is to allow the bottom of the insulator to pivot away from the cylinder and then to fold the cylinder flat for storage. Of course, when the cylinder is folded, the two fold areas are distorted just as in the previous designs, and thus are subject to being damaged and rendered unsightly, just as before.

Especially over the last decade since the issuance of the '525 patent, other inventors have tried to alleviate the problem by going to an insulator wrap and moving away from the statically shaped cylinder. One of the major efforts to find a truly popular and commercial viable insulator to replace this earlier type focused on connecting the ends of the wrap to hold around the container during use. One example of this effort is illustrated in U.S. Pat. No. 5,163,608, issued Nov. 17, 1992. The proposed solution in this instance is the use of metal snap fasteners; preferably three along the width of the wrap. Once the wrap is positioned around the container, the fasteners are individually coupled by pressing inwardly against the container. The shortcoming of this particular design is readily apparent. Not only are the snaps expensive but they protrude outwardly to interfere with the smooth outer holding surface, thus making the wrap generally uncomfortable to use. Over time, portions of the snaps that are ferrous metal are subject to rust. Repeated unsnapping, eventually leads to the fasteners pulling out of the foam material, thus making the '608 wrap unsightly and/or totally unuseable.

A follow-up effort to alleviate the problems of the '608 patent and similar arrangements is typified by the insulator wrap shown in U.S. Pat. No. 5,325,991, issued Jul. 5, 1994. The approach here is to simply replace the snap fasteners with the common hook and loop fastener. While such an arrangement has some advantages over the other prior art, a recognized shortcoming is that the hook and loop fastener pads when the wrap is opened tend to get caught on clothing and/or other objects, thereby causing a nuisance. The pads also are subject to accumulating debris and harboring harmful bacteria.

Most recently, an insulator wrap has been designed to eliminate fasteners by using a pair of self-coiling strips embedded in the foam material body. This approach is shown in U.S. Pat. No. 5,845,804, issued Dec. 8, 1998. While the disadvantage of having snap fasteners or hook and loop pad fasteners is solved, several shortcomings remain. First, two spring strips are required which makes the device more expensive, and in addition more difficult to manufacture. The springs are required to be positioned closely adjacent to the top and bottom edges of the foam material, which limits the area for an adhesive layer when the foam material is laminated using two sheets. This shortcoming is particularly troublesome during extended use over time since the narrow portions providing the adhesive to form the lamination are prone to come loose and expose the sharp edges of the springs. Also, further making this approach particularly unsatisfactory is the requirement to manually activate two spring strips when going to or from the coiled state.

Accordingly, a need is identified for a new, improved approach that takes advantage of the self-coiling nature of a spring strip, as first identified in the '804 patent, but providing an insulator wrap of this type that is much less expensive and not subject to the other limitations that are identified. The improved insulator wrap would provide for increased area for an adhesive interface between the edges of the spring strip and the top and bottom of laminated foam sheets forming the body. Furthermore, the new approach would be characterized by the improved self-coiling action, especially given the fact that only one spring strip must be activated. Also, the functionality of the wrap should be improved by incorporating structure that allows the comers of the insulator wrap to be snugly positioned against the container when in use.

SUMMARY OF THE INVENTION

Accordingly, it is an object of the present invention to provide an improved insulator wrap designed to overcome the shortcomings and disadvantages of the prior art described above.

Another more specific object of the present invention is to provide an insulator wrap adapted for use on a beverage container that is simplified and inexpensive to manufacture in order to increase the commercial viability thereof.

Another object of the present invention is to provide an improved insulator wrap for a beverage container wherein a single, self-coiling spring strip is embedded in a body of insulation material in such a manner that the spring strip is isolated from the edges of the wrap by extended portions of the insulation body, and the spring strip exhibits enhanced self-coiling action and improved snugging action at the comers.

Additional objects, advantages, and other novel features of the invention will be set forth in part in the description that follows, and in part will become apparent to those skilled in the art upon examination of this description, or may be learned with the practice of the invention. The different structures/materials and advantages of the invention utilizing the same may be realized and obtained by means of the instrumentalities in combinations particularly pointed out in the appended claims.

To achieve the foregoing and other objects, and in accordance with the purposes of the present invention as described herein, a novel insulator wrap is provided that is particularly adapted for a standard beverage container, such as a 12 oz. soft drink can. The inventive insulator wrap comprises a substantially rectangular body of insulation material that is defined by top and bottom and opposite end edges. A single, self-coiling spring strip is embedded in the body along approximately the longitudinal center line. When the spring strip is uncoiled, it is curved in lateral cross section. In this state, it is inherently held straight so as to hold the body substantially flat or open. The wrap in this state is especially adapted for easy and compact storage. When manual pressure is applied to the ends of the strip, self-coiling action causes the body to snap around the container in a snug manner. The spring strip and body portions extending laterally from the edges of the spring strip occupy substantially the full width of the body and thereby maximize the isolation of the spring strip from the top and bottom edges of the wrap. Preferably, the extended body portions are at least one and one half times as wide as the spring strip in order to provide the maximum isolation.

The body of the insulator wrap is preferably formed of inner and outer juxtaposed foam sheets, and one or more adhesive layers forming a continuous interface along the body portions to allow maximum adhesive holding action and to assure the spring strip remains isolated, even after extended use. A plastic cover sheet, such as a smooth vinyl, may be adhesively attached on top of the outer foam sheet in order to provide the desired display surface for printed graphics and/or indicia, such as advertising text, logos and the like. At least the inner foam sheet includes open cells to absorb and wick condensation away from the container during use when on a chilled beverage container.

When the spring strip is in the uncoiled state to hold the insulator wrap open or straight for storage during non-use, an elongated concave trough is formed along its length on the side adapted to face outwardly away from the container. In accordance with another feature of the present invention, a foam insert is positioned to fill the trough in this uncoiled state, and to be compressed in the self-coiled state so as to provide a substantially smooth display surface for graphics in either state. A related feature of the present invention is the provision of elongated stiffening stays that are embedded adjacent the ends of the wrap. This allows transfer of the self-coiling force of the spring strip to snug the top and bottom corners against the container. For maximum snugging force, each stay is positioned inwardly of the spring strip toward the container and in contact therewith. In addition, the stays can be preformed in an inward bow to further enhance the snugging action.

Still other advantages and features of the present invention will become readily apparent to those skilled in this art from the following description wherein there is shown and described a preferred embodiment of this invention, simply by way of illustration of one of the modes best suited to carry out the invention. As it will be realized, the invention is capable of other different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENT

Figures 1, 6, 7:
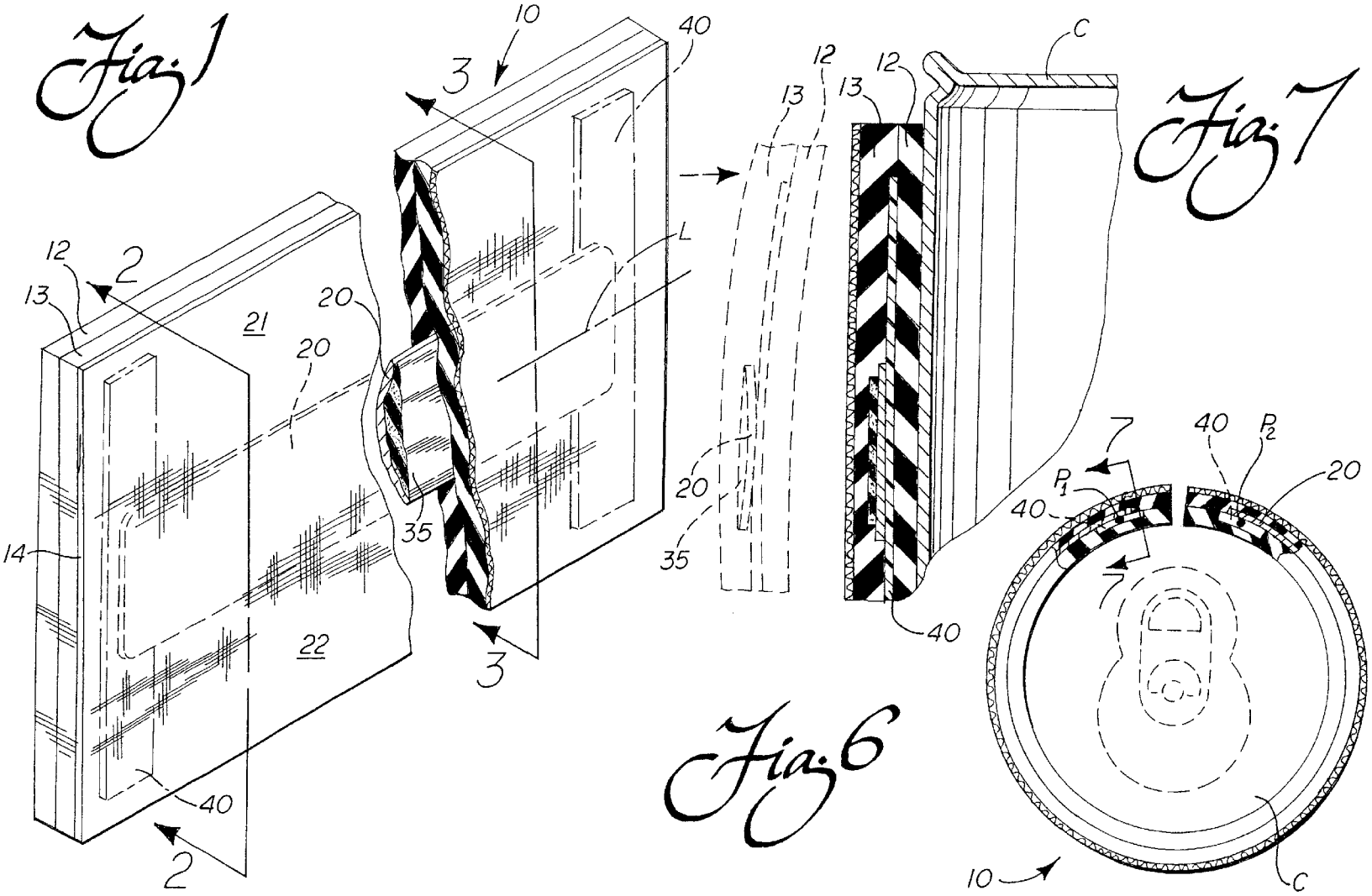
FIG. 1 is a plan view of the insulator wrap of the present invention, with a portion cut away and with phantom illustrations of some components to provide a clearer understanding of the present invention.
FIG. 6 is a top view illustrating the wrap of the present invention positioned in the self-coiled state snugged on a beverage can.
FIG. 7 is a partial cross sectional view taken along the plane of line 7—7 of FIG. 6 and showing the enhanced snugging action that is provided by the alternative preformed stays at the ends of the insulator wrap.
Figure 5:
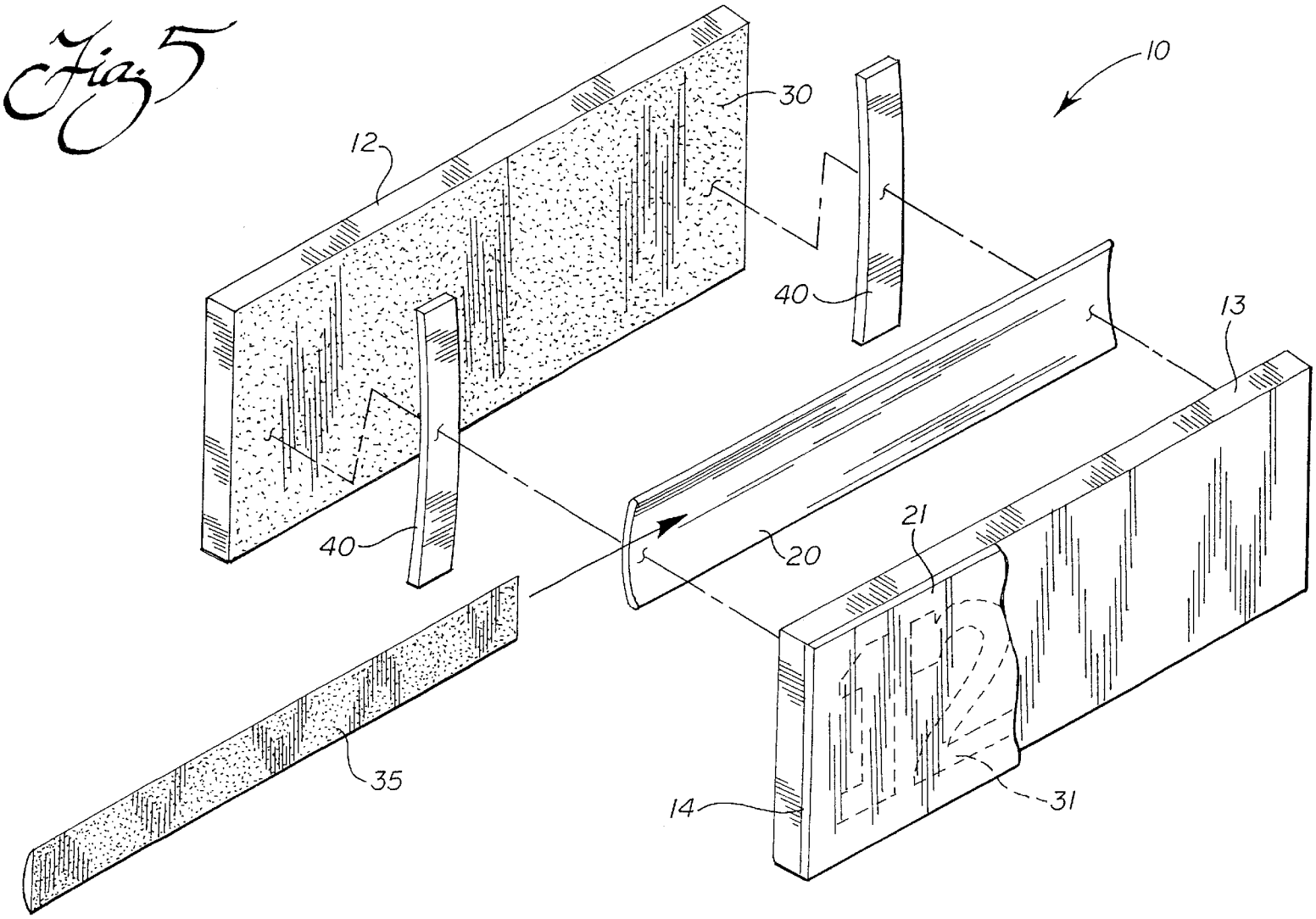
FIG. 5 is an exploded view of the insulator wrap of the present invention showing the manner in which the several component parts are integrated together.

An insulator wrap 10 constructed in accordance with the teachings of the present invention is illustrated in the cutaway plan view of FIG. 1, and additional detail can be visualized by viewing FIG. 1 in conjunction with the exploded view of FIG. 5. In the preferred embodiment illustrated for setting forth the principles of the present invention, the wrap 10 includes a substantially rectangular body of insulation material, the body including a basic three sheet laminate, generally designated by the reference numeral 11. There are two sheet of plastic or rubber foam 12, 13 and an outer vinyl plastic cover 14 forming the rectangular body 11. Top and bottom edges of the body 11 define the width of the insulator wrap 10, and opposite end edges in a like manner define the length thereof.

Figures 2, 3, 4, 4A, 4B:
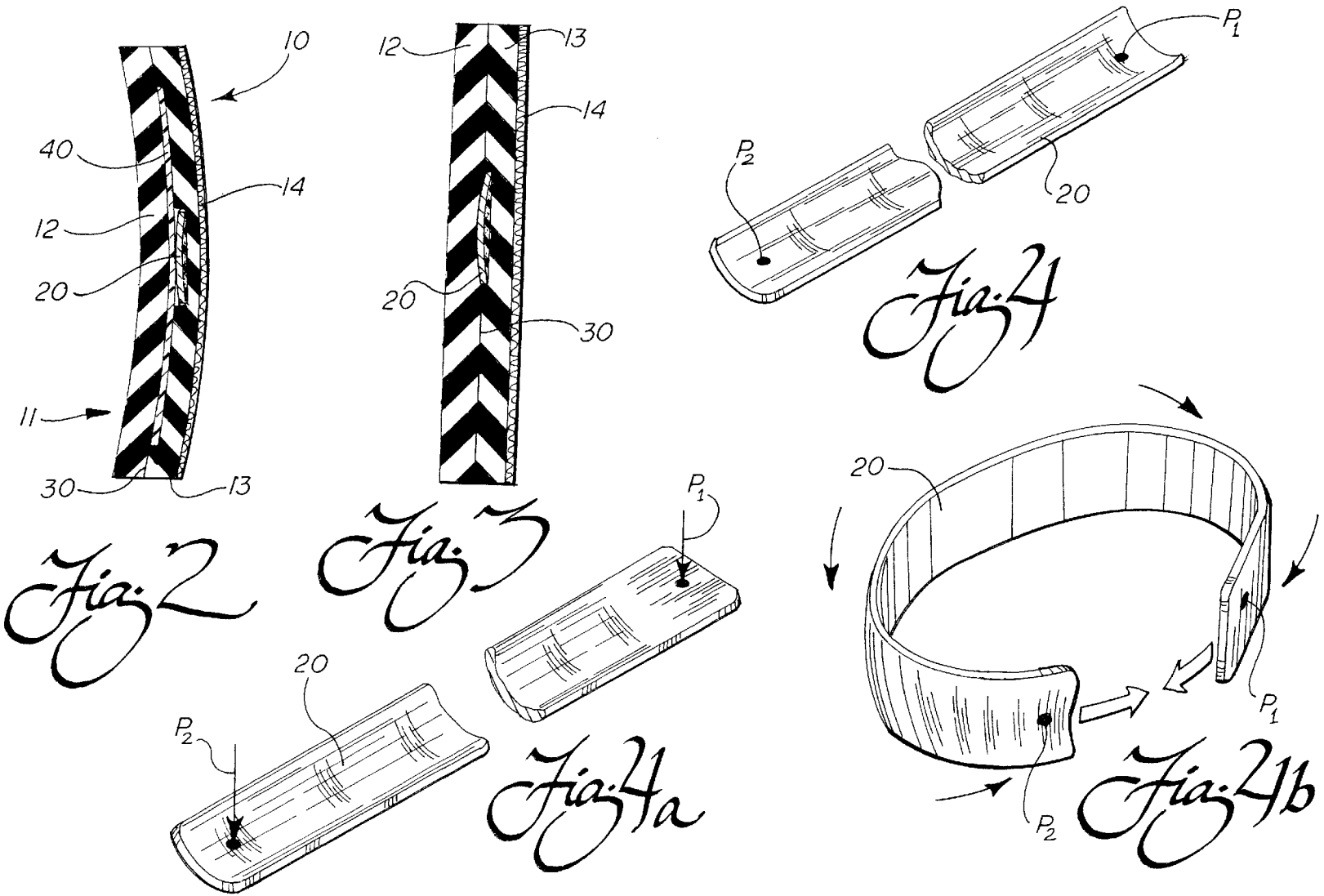
FIG. 2 is a cross sectional view taken along the plane of line 2—2 illustrating the alternative inward bow of the stays positioned adjacent the end edges of the insulator wrap.
FIG. 3. is a cross sectional view taken along the plane of the line 3—3 of FIG. 1, and illustrating the center section of the insulator wrap of the present invention.
FIGS. 4, 4*a*, 4*b* are a series of illustrations of the spring strip separated from the insulator wrap and showing the nature of the action moving from the uncoiled state to the self-coiled state.

A self-coiling spring strip 20 is embedded in the body 10 along approximately the center line L, as illustrated in FIG. 1. As best represented in FIG. 5, the spring strip 20 is characterized by being curved in the lateral cross section in order to hold straight when uncoiled. As represented in FIGS. 4–4*b*, and 5 and as will be explained more in detail below, upon being snapped flat at the end(s) by manual pressure, the spring strip is free to self-coil, and when used in the insulator wrap 10 it self-coils inwardly toward the container to cause the body 10 to fit in a snug manner around container C (see FIG. 6).

With reference back to FIG. 1, first and second portions of the body are extended on opposite sides of the spring strip 20. As illustrated in accordance with the present invention, the single self-coiling spring strip 20 and the body portions 21, 22 occupy substantially the full width of the body 11. These extended body portions 21, 22 are sufficiently spaced from the spring strip 20 in order to provide maximum isolation of the strip in the body 11. Preferably, the body portions 21, 22 are at least one and one half times as wide as a spring strip in order to provide the preferred, extended isolation.

The body 11 is fabricated as a lamination by adhesively joining the inner and outer juxtaposed foam sheets 12, 13. An adhesive layer, represented by the area 30 on the foam sheets 12, 13 (see FIGS. 3 and 5) forms a substantially continuous interface to maximize the holding action and to assure that the spring strip isolating action of the extended body portions 21, 22 is maintained. The adhesive 30 can either be sprayed or otherwise applied to the inner sheet 12, the outer sheet 13, and/or on the other internal components, as desired. During assembly, the spring strip 20 is positioned within the adhesive area 30 and the two sheets 12, 13 are then brought together to form the lamination. The vinyl cover sheet 14 is applied separately by a similar adhesive area (not shown) on the top of the outer foam sheet 13. As illustrated in FIG. 5, the cover sheet 14 provides a smooth display surface for printed graphics and indicia, designated by the reference numeral 31.

A variety of foam sheets can be utilized for fabrication of the inner and outer sheets 12, 13; however, it is preferred that the inner foam sheet 12 include open cells to absorb and wick condensation away from the container C during use. While the insulator wrap 10 is primarily designed for use with cold containers, it is to be understood that within the broader aspects of the invention the insulator wrap 10 applies to hot containers (not shown), as well. Also, the outer foam sheet can be of a different texture, as desired, in order to provide the exact laminate combination desired. A selected combination to provide the best self-coiling action around the container C, while also being low in cost, is contemplated.

As best illustrated in FIGS. 1 and 5, a foam insert 35 is provided to fit in the elongated concave trough of the spring strip 20 along its length. This serves as a filler to substantially eliminate any distortion of the outer sheet 13 when the lamination is formed to complete the insulator wrap 10. In other words, the foam is expanded in the uncoiled or open state in order to substantially level the surface of the outer sheet 13 and cover sheet 14. When the insulator wrap 10 is self-coiled to embrace the container C (FIG. 6) the foam sheet 35 is compressed so that distortion that might otherwise occur is prevented.

In accordance with another feature of the present invention, an elongated stiffening stay 40 is embedded laterally across each end of the body 11. As illustrated, each of the stays 40 extends adjacent the corresponding end of the spring strip 20. Such positioning best allows transfer of the self-coiling force of the spring strip 20 to the stays. This allows the spring force to best snug the top and bottom corners of the body 11 against the container C (see FIG. 6). Specifically, the stays 40 are directed toward the inner foam sheet 12 that is positioned toward the container, as best illustrated in FIG. 5.

In accordance with another preferred feature of the present invention, the stay 40 is formed of resilient plastic, such as PVC, with a preformed bow directed in the direction of the inner sheet 12 to provide additional snugging action at the comers. In order words, as best shown in FIG. 7, as the insulator wrap 10 is brought into engagement with the container C, the supplemental spring action presses the wrap 10 against the container C. The bow in the stay 40 is flattened or canceled and the inherent resiliency in the preformed stay thus adds snugging force directed toward the corners (note the dashed line to full line positions of FIG. 7).

As mentioned above, the manipulation of the spring strip 20 in order to move from the uncoiled to the coiled state is illustrated in FIGS. 4–4*b*. The imaginary snap pressure points $P_1$, $P_2$ are identified on the spring. With the spring embedded in the insulator wrap 10, and it being understood that the convex side illustrated in FIG. 4 faces outwardly, the pressure point $P_1$ or $P_2$ is initially pressed against the side of the container C to install the wrap. As the pressure is applied through the foam sheet 12, on the selected pressure point $P_1$, $P_2$ the spring strip 20 snaps so that it moves to the self-coiled state around the container C. This action is shown in FIG. 4*b* by viewing the action arrows. The same coiling action can be induced by providing the manual pressure to either of the pressure points $P_1$, $P_2$ (see FIG. 4*a*). To remove the wrap 10 from the container C, the opposite manual pressure through the foam sheet 12 is applied to the points $P_1$, $P_2$ during lifting of the wrap 10 away from the container. This serves to snap the internal spring strip 20 back into the straight or uncoiled position.

In summary, an insulator wrap 10 for a beverage container C is provided that is simplified for easier manufacturing and lower cost, while at the same time engineered for improved operation efficiency. Manipulation of only one self-coiling spring strip 20 is all that is required in order to install or remove the wrap. A snug fit of the body 11 against the container C is assured by the spring action. Extended first and second portions 21, 22 on opposite sides of the spring strip assures that the insulator body remains securely laminated and the spring strip 20 is isolated from the top and bottom edges. A foam insert 35 allows the insulator wrap 10 to always have a substantially smooth display surface for graphics and indicia. As an additional feature, stiffening stays 40 can be added at the ends of the wrap 10 to transfer the force of the spring to increase the snugging action at the top and bottom corners against the container C. If desired, the stays are formed of resilient PVC plastic and an inward preformed bow can be provided to the stays in order to add to the snugging force.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. An insulator wrap for a beverage container comprising:

a substantially rectangular body of insulation material having top and bottom edges defining the width and the opposite end edges defining the length of said body;

a self-coiling spring strip embedded in said body, at least a portion of said strip touching along the longitudinal centerline;

said spring strip characterized by being curved in lateral cross section to hold straight when uncoiled, and upon being bent by manual pressure is free to self-coil inwardly to cause the body to fit in a snug manner around the container;

first and second portions of said body extending laterally from the edges of said spring strip;

said spring strip and body portions occupying substantially the full width of said body.

2. The insulator wrap of claim 1, wherein the edges of the body formed by the first and second extended body portions are sufficiently spaced from said spring strip to provide maximum isolation of the edges of said spring strip in said body.

3. The insulator wrap of claim 2, wherein the first and second extended body portions are at least one and one-half times as wide as said spring strip to provide the isolation.

4. The insulator wrap of claim 1, wherein the curved cross section of said spring strip forms an elongated concave trough along its length on the side adapted to face outwardly away from said container; and a foam insert extending along said trough to fill the same sufficiently when in the uncoiled state and be compressed when in the self-coiled state to provide a substantially smooth display surface for graphics and indicia in either state.

5. The insulator wrap of claim 1, wherein is provided an elongated stiffening stay embedded laterally across each end of the body and each extending adjacent the corresponding end of said spring strip to transfer its self-coiling force to snug the top and bottom comers of the body against said container.

6. The insulator wrap of claim 5, wherein each stay is positioned inwardly of said spring strip toward said container and in contact with said spring strip to maximize the snugging action at the comers.

7. The insulator wrap of claim 6, wherein each stiffening stay is preformed in an inward bow to provide additional snugging action at the comers against the container.

8. The insulator wrap of claim 1, wherein said body is formed of inner and outer juxtaposed foam sheets and an adhesive layer forming a substantially continuous interface to maximize the adhesive holding action and assure the spring strip isolating action of the extended body portions.

9. The insulator wrap of claim 8, wherein is provided a plastic cover sheet on said outer foam sheet having a smooth display surface for printed graphics and indicia.

10. The insulator of claim 8, wherein at least said inner foam sheet includes open cells to absorb and wick condensation away from said container into said sheet during use.

* * * * *